US011684527B2

(12) United States Patent
Vuorenoja et al.

(10) Patent No.: US 11,684,527 B2
(45) Date of Patent: Jun. 27, 2023

(54) ARRANGEMENT FOR MOUNTING A PLANE ON A WALL

(71) Applicant: Frestems Oy, Sastamala (FI)

(72) Inventors: Ari-Matti Vuorenoja, Sastamala (FI); Marko Hietaranta, Sastamala (FI); Markus Hietaranta, Sastamala (FI)

(73) Assignee: FRESTEMS OY, Sastamala (FI)

( * ) Notice: Subject to any disclaimer, the term of this patent is extended or adjusted under 35 U.S.C. 154(b) by 275 days.

(21) Appl. No.: 17/291,454

(22) PCT Filed: Nov. 21, 2019

(86) PCT No.: PCT/FI2019/050833
§ 371 (c)(1),
(2) Date: May 5, 2021

(87) PCT Pub. No.: WO2020/104729
PCT Pub. Date: May 28, 2020

(65) Prior Publication Data

US 2022/0000685 A1 Jan. 6, 2022

(30) Foreign Application Priority Data

Nov. 23, 2018 (FI) ..... 20185993

(51) Int. Cl.
*A61G 3/08* (2006.01)
*A47B 5/04* (2006.01)
*A47B 5/00* (2006.01)

(52) U.S. Cl.
CPC ..... *A61G 3/085* (2013.01); *A47B 5/04* (2013.01); *A61G 3/0841* (2013.01); *A47B 5/006* (2013.01)

(58) Field of Classification Search
CPC ..... A47B 5/04; A47B 5/006
See application file for complete search history.

(56) References Cited

U.S. PATENT DOCUMENTS 3,606,619 A 9/1971 Hans
4,100,858 A * 7/1978 Bue ..... A47B 5/04 108/48

(Continued)

FOREIGN PATENT DOCUMENTS

DE 1161386 1/1964
EP 1197164 A1 * 4/2002 ..... A47B 5/006

(Continued)

OTHER PUBLICATIONS

European Search Report in EP Application No. 19886282.3-1113/3883431, dated Jul. 20, 2022 (8 pages).

*Primary Examiner* — Daniel J Rohrhoff
(74) *Attorney, Agent, or Firm* — Leason Ellis LLP

(57) ABSTRACT

Arrangement for mounting a plane (2) on a wall (1). The arrangement comprises said plane (2) and, supporting said plane (2), a first support arm (4) and a second support arm (5), the support arms (4, 5) are connectable to the wall (1) by their first end (4',5') by means of a first joint arrangement (6, 7) so that the support arms (4, 5) are turnable in a substantially horizontal plane in relation to the wall (1). The support arms (4, 5) are mounted in connection with the plane (2) by their second ends (4",5") by means of a second joint arrangement (10, 11) connected the second end (4",5") of the support arm (4, 5). The second joint arrangement (10, 11) comprises a joint (14, 15) provided with a substantially horizontal turning axis, whereby said plane (2) is turnable to a substantially horizontal usage position and a substantially vertical storage position by means of said joints (14, 15) provided with a substantially horizontal turning axis.

20 Claims, 4 Drawing Sheets

(56) References Cited

U.S. PATENT DOCUMENTS

| | | | | | |
|---|---|---|---|---|---|
| 4,378,128 | A * | 3/1983 | Holling | A61G 3/0236 | 5/9.1 |
| 6,055,688 | A * | 5/2000 | Helmsderfer | A47D 5/003 | 5/655 |
| 8,479,664 | B2 * | 7/2013 | Nelson | A47B 5/04 | 108/42 |
| 2008/0023976 | A1 * | 1/2008 | Myers | A61G 3/0891 | 296/19 |
| 2019/0375325 | A1 * | 12/2019 | Zappolini | A47B 13/088 | |
| 2022/0117389 | A1 * | 4/2022 | O'Hara | A47B 5/006 | |

FOREIGN PATENT DOCUMENTS

| | | |
|---|---|---|
| EP | 1 586 803 | 10/2005 |
| EP | 2 349 161 | 8/2011 |
| WO | WO 2010043753 | 4/2010 |
| WO | WO 2011/100807 | 8/2011 |

* cited by examiner

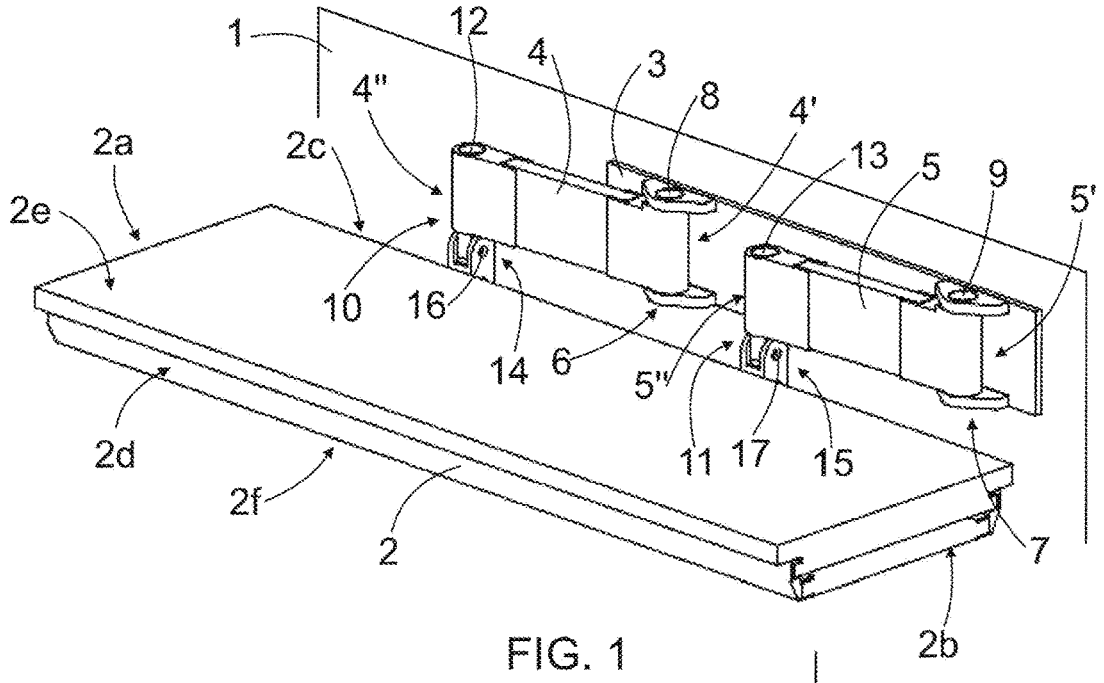
FIG. 1
FIG. 2
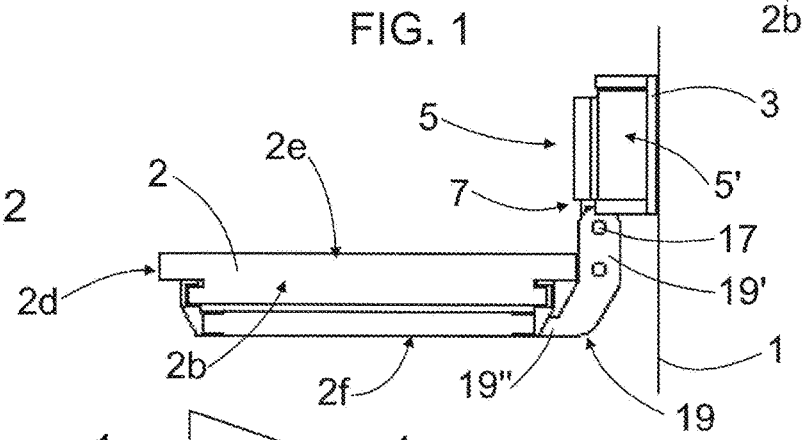
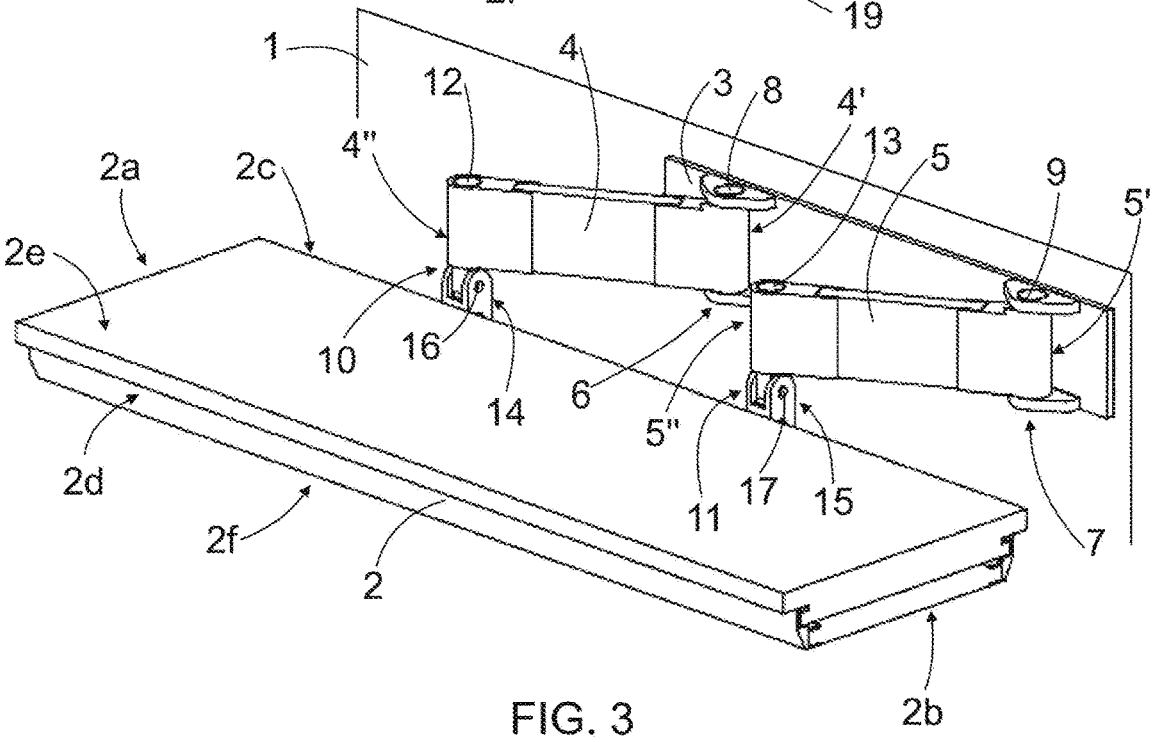
FIG. 3

ARRANGEMENT FOR MOUNTING A PLANE ON A WALL

CROSS-REFERENCE TO RELATED PATENT APPLICATIONS

This application is a U.S. National Phase Application under 35 U.S.C. § 371 of International Patent Application No. PCT/FI2019/050833, filed Nov. 21, 2019, which claims priority to FI Application No. 20185993, filed Nov. 23, 2018, all of which are incorporated by reference, as if expressly set forth in their respective entireties herein.

BACKGROUND OF THE INVENTION

The invention relates to an arrangement for mounting a plane on a wall.

EP publication 2349161 B1 discloses an arrangement for mounting a plane on a wall of a vehicle. Said plane establishes a base or platform for a patient or transport stretcher used in an ambulance vehicle. The plane is mounted on a wall of the vehicle by support arms and associated joints so that the plane may be horizontally moved away from the wall to a more central position in the vehicle and back alongside the wall. The plane may be moved away from the wall for a treatment procedure of a patient lying down, for example, or for receiving a patient lying on a stretcher into a vehicle, to be supported by the plane, or for moving a patient out of the vehicle and from being supported by the plane. The plane may be moved back alongside the wall for the transport of a patient lying down, or when there are no patients in the vehicle. When the plane has been moved alongside the wall, the support arms of the plane run substantially parallel to the vehicle wall, and when the plane is moved away from the wall, the support arms are at least partly oriented outward of the wall.

The arrangement disclosed in EP publication 2349161 B1 in practice restricts the utilization of a vehicle in said ambulance use to the transportation of patients in a lying down position, only, because the vehicle cannot be easily converted into a vehicle equipped with seats, for example, for transporting patients who are in a sitting position.

BRIEF DESCRIPTION OF THE INVENTION

It is therefore an object of the invention to provide a new type of arrangement for mounting a plane on a wall.

The solution according to the invention is characterized by what is disclosed in the independent claim.

The invention is based on a second joint arrangement of the support arm comprising a joint provided with a substantially horizontal turning axis, whereby said plane is turnable to a substantially horizontal usage position and to a substantially vertical storage position by means of said joints provided with a substantially horizontal turning axis.

An advantage of the invention is that in order to equip a vehicle in e.g. ambulance use with seats for patients transported in a sitting position, the plane and possibly its support arms need not be removed from the vehicle but the plane may be turned out of the way beside the wall in a substantially vertical storage position whereby it is easy to accomplish enough space in the vehicle to provide it with seats.

Some embodiments of the invention are presented in the dependent claims.

BRIEF DESCRIPTION OF THE FIGURES

The invention is now described in closer detail in connection with preferred embodiments and with reference to the accompanying drawings, in which FIG. 1 is a schematic view obliquely from above of an arrangement for mounting a plane on a wall when the plane is in its horizontal usage position alongside the wall;

FIG. 2 is a schematic end view of the arrangement of FIG. 1 when the plane is in its horizontal usage position alongside the wall;

FIG. 3 is a schematic view obliquely from above of the arrangement of FIG. 1 when the plane is in its horizontal usage position and moved outward from the wall;

For reasons of clarity, some embodiments of the invention are illustrated in the figures in a simplified form. In the figures, like reference numerals identify like elements.

DETAILED DESCRIPTION OF THE INVENTION

Figure 4:
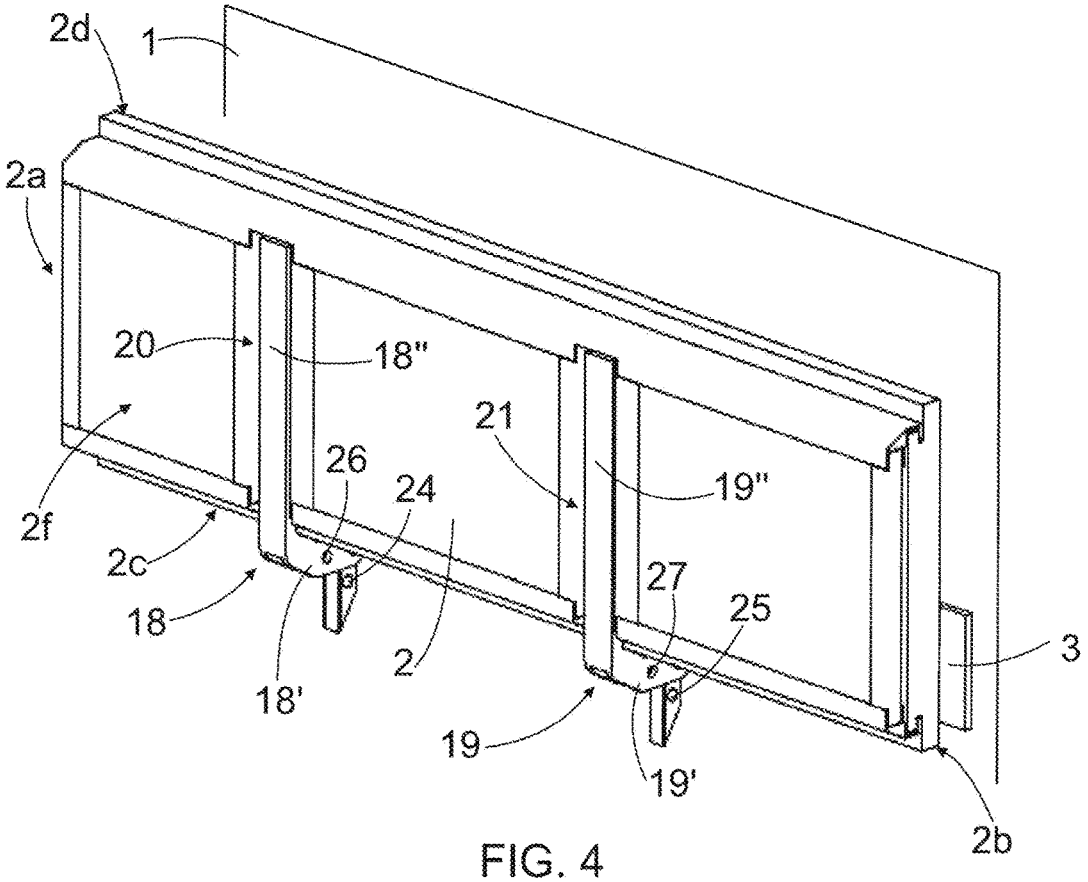
FIG. 4 is a schematic view obliquely from above of the arrangement of FIG. 1 when the plane is in its vertical storage position alongside the wall.
Figure 5:
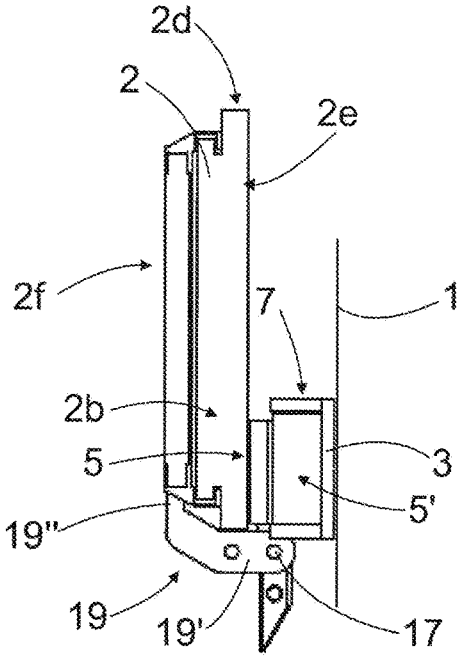
FIG. 5 is a schematic end view of the arrangement of FIG. 1 when the plane is in its vertical storage position alongside the wall.

FIG. 1 is a schematic view obliquely from above of an arrangement for mounting a plane 2 on a wall 1 when the plane 2 is in its horizontal usage position alongside the wall 1, FIG. 2 is a schematic end view of the arrangement of FIG. 1 when the plane 2 is in its horizontal usage position alongside the wall 1, and FIG. 3 is a schematic view obliquely from above of the arrangement of FIG. 1 when the plane 2 is in its horizontal usage position and moved outward from the wall 1. Further, FIG. 4 is a schematic view obliquely from above of the arrangement of FIG. 1 when the plane 2 is in its vertical storage position alongside the wall 1, and FIG. 5 is a schematic end view of the arrangement of FIG. 1 when the plane 2 is in its vertical storage position alongside the wall 1.

The plane 2 may form e.g a platform or base which may be used to support a patient in a lying down position on a patient stretcher to transport the patient, or to carry out treatment procedures on the patient. In this case, the wall 1 may comprise an inner wall of an ambulance vehicle or another means of transportation, such as a helicopter or airplane, in connection with which the plane 2 is arranged. The plane 2 may also form a platform or base for supporting items or pieces of equipment to be transported. The platform 2 may in such a case be provided with e.g. substantially vertically upward extending sides to prevent the items or pieces of equipment from falling off the plane. A vehicle provided with an aforementioned plane 2 may form a mobile service point or vehicle, for example. The practical implementations, purposes and targets of use of the plane 2 may therefore be most diverse and not explicitly restricted to uses or purposes relating to treating or rescuing people although the mounting arrangement presented in the solution according to the following examples as well as the application of the plane 2 therein is assumed to be associated in particular with a mounting arrangement used in an ambulance vehicle for mounting a plane suited to receiving a patient stretcher on a wall structure of the ambulance vehicle.

The plane 2 comprises a front end 2*a* to be directed towards a front of a vehicle, a rear end 2*b* to be directed towards a rear of a vehicle, a first side edge 2*c* to be directed towards a wall 1 of a vehicle, a second side edge 2*d* to be directed away from a wall 1 of a vehicle, a top surface 2*e* to be directed upward, and a bottom 2*f* to be directed downward. For reasons of clarity, the figures do not show means included in the plane 2 for locking the patient stretcher to the plane 2.

The arrangement for mounting the plane 2 on the wall 1 comprises a first support arm 4 and a second support arm 5, positioned on the first side edge 2*c* side of the plane 2 and supporting the plane 2. The support arms 4, 5 have first ends 4',5' to be fixed to the wall 1, and second ends 4",5" to be fixed to the plane 2. In the longitudinal direction of the plane 2 between the front end 2*a* and rear end 2*b* of the plane 2, the first support arm 4 is arranged for positioning on the front end 2*a* side of the plane 2, and the second support arm 5 is arranged for positioning on the rear end 2*b* side of the plane 2. The first ends 4',5' of the support arms 4, 5 are fixed to a wall mount 3, common for the support arms 4, 5 and to be fixed to the wall 1, whereby the support arms 4, 5 are fixed to the wall 1 by means of said one common wall mount 3. However, the support arms 4, 5 may also be fixed to the wall 1 by separate wall mounts arranged for them.

The first end 4',5' of the support arm 4, 5 has a first joint arrangement 6, 7 by means of which the first ends 4',5' of the supports arms 4, 5 connect to the wall 1 at substantially the same horizontal level. The first joint arrangement 6, 7 comprises a joint shaft 8, 9 running through the first end 4',5' of the support arm 4, 5 in a substantially vertical direction. At the first end 4',5' of the support arm 4, 5, said joint shaft 8, 9 forms a substantially vertical turning axis in relation to which the first end 4',5' of the support arm 4, 5 may turn in relation to the wall 1 so that the support arm 4, 5 turns in relation to the wall 1 in a substantially horizontal plane whereby the plane 2 may be moved substantially horizontally away from the wall 1 to the position shown in FIG. 3 and back towards the wall 1 alongside the wall 1 to the position shown in FIG. 1.

At the first end 4",5" of the support arm 4, 5 there is a second joint arrangement 10, 11 by means of which the second end 4",5" of the support arm 4, 5 connects to the plane 2. The second joint arrangement 10, 11 comprises a joint shaft 12, 13 running through the second end 4",5" of the support arm 4, 5 in a substantially vertical direction. At the second end 4",5" of the support arm 4, 5, the joint shaft 12, 13 forms a substantially vertical turning axis in relation to which the second end 4",5" of the support arm 4, 5 may turn when the plane 2 is moved substantially horizontally away from the wall 1 to the position shown in FIG. 3 and back towards the wall 1 alongside the wall 1 to the position shown in FIG. 1.

The joint shaft 12, 13 included in the second joint arrangement 10, 11 is dimensioned and arranged in the second joint arrangement 10, 11 so that the joint shaft 12, 13 extends in the vertical direction of the support arm 4, 5 below the second end 4",5" of the support arm 4, 5. In such a case, in the joint shaft 12, 13 portion extending below the second end 4",5" of the support arm 4, 5, it is possible to arrange a substantially horizontally running joint shaft 16, 17 for example through the joint shaft 12, 13, as shown in the figures, in order to arrange the joint 14, 15 provided with a substantially horizontal turning axis as part of the second joint arrangement 10, 11 whereby the joint shaft 16, 17 thus forms the turning axis of the joint 14, 15 provided with a substantially horizontal turning axis, and the joint 14 forms a first joint provided with a horizontal turning axis and connected to the first support arm 4, and the joint 15 forms a second joint provided with a horizontal turning axis connected to the second support arm 5 at substantially the same horizontal level. By means of said joints 14, 15, the plane 2 may be turned to the substantially horizontal usage position shown in FIGS. 1, 2 and 3, and to the substantially vertical storage position shown in FIGS. 4 and 5. Alternatively, the joint shaft 16, 17 may be formed by substantially horizontal shaft extensions arranged on the joint shafts 12, 13 and not running through the joint shaft 12, 13. In the aforementioned embodiments, the joint 14, 15 provided with a horizontal turning axis is consequently directly arranged to the portion of the vertical joint shaft (12, 13), which extends below the second end (4",5") of the support arm (4, 5).

When the plane 2 is turnable to the substantially vertical storage position shown in FIGS. 4 and 5, a space in a vehicle in e.g. ambulance use, originally reserved for a patient to be transported in a lying down position, may be equipped with seats for patients to be transported in a sitting position so that the plane 2 and possibly also its support arms 4, 5 need not be removed from the vehicle but by only turning the plane 2 out of the way alongside the wall 1 in a substantially vertical storage position it is easy to accomplish enough space in the vehicle to provide it with seats.

In the embodiment shown in the figures, the joint shaft 12, 13 forms a first joint part of said joint 14, 15 provided with a horizontal turning axis, and a support structure 18, 19 arranged in connection with the plane 2, in the embodiment of the figures in connection with the bottom 2*f* of the plane 2, in particular, forms a second joint part of the joint 14, 15. So, the support structure 18 forms the second joint part connected to the joint 14 in the first support 4 and provided with a horizontal turning axis, whereas the joint shaft 12 forms the first joint part connected to said joint 14. Correspondingly the support structure 19 forms the second joint part connected to the joint 15 in the second support 5 and provided with a horizontal turning axis, whereas the joint shaft 13 forms the first joint part connected to said joint 15. When said support structures 18, 19 turn in relation to the joint shafts 12, 13 by means of the horizontal turning axis formed by the joint shafts 16, 17, the plane 2 may be turned to the substantially horizontal usage position and back to the substantially vertical storage position.

The support structure 18, 19 comprises, in the substantially horizontal usage position of the plane 2, a first portion 18',19' to be oriented substantially vertically, and in connection with it a second portion 18",19" to be oriented substantially horizontally and arranged in connection with the bottom 2*f* of the plane 2. The first portion 18' 19' of the support structure 18, 19, to be oriented substantially vertically, forms the portion of the support structure 18, 19 connected to the joint 14, 15 provided with said horizontal turning axis. Said first portion 18',19' of the support structure 18, 19 is advantageously dimensioned and arranged to extend over the top surface 2*e* of the plane 2 to the extent that the joint shaft 16, 17 forming the turning axis of the joint 14, 15 provided with a horizontal turning axis may be arranged to be positioned over the top surface 2*e* of the plane 2. As a result, the plane 2 may be turned up to a 90-degree vertical position, or even more, in relation to the horizontal usage position of the plane 2 before the plane 2 hits the support arms 4, 5 when the plane 2 is turned to its substantially vertical storage position.

In the embodiment of the figures, the second portion 18",19" of the support structure 18, 19, which is to be oriented substantially horizontally, is a support structure running in the substantially lateral direction between the side edges 2*c*, 2*d* of the plane 2. In the bottom 2*f* of the plane 2, there are arranged recesses 20, 21 matching said second portions of the support structures 18",19" to receive said second portions 18",19" of the support structures 18, 19 without adding to the height of the plane 2. FIG. 4 further shows locking openings 24, 25 arranged in the bottom parts of the joint shafts 12, 13, and locking openings 26, 27 arranged in the first portions 18',19' of the support structure 18, 19, which are aligned and with locking pins adapted through which the plane 2 may be locked in place in relation to the joints 14, 15 when the plane 2 is in its substantially horizontal usage position. The plane 2 may in turn be locked in the substantially vertical storage position e.g. by means of a locking arranged between the plane 2 and the wall 1 or support arm 4, 5, such as by a locking screw to be turned through an opening formed through the plane 2 to a counterpart arranged in the wall 1 or the support arm 4, 5.

Figure 6:
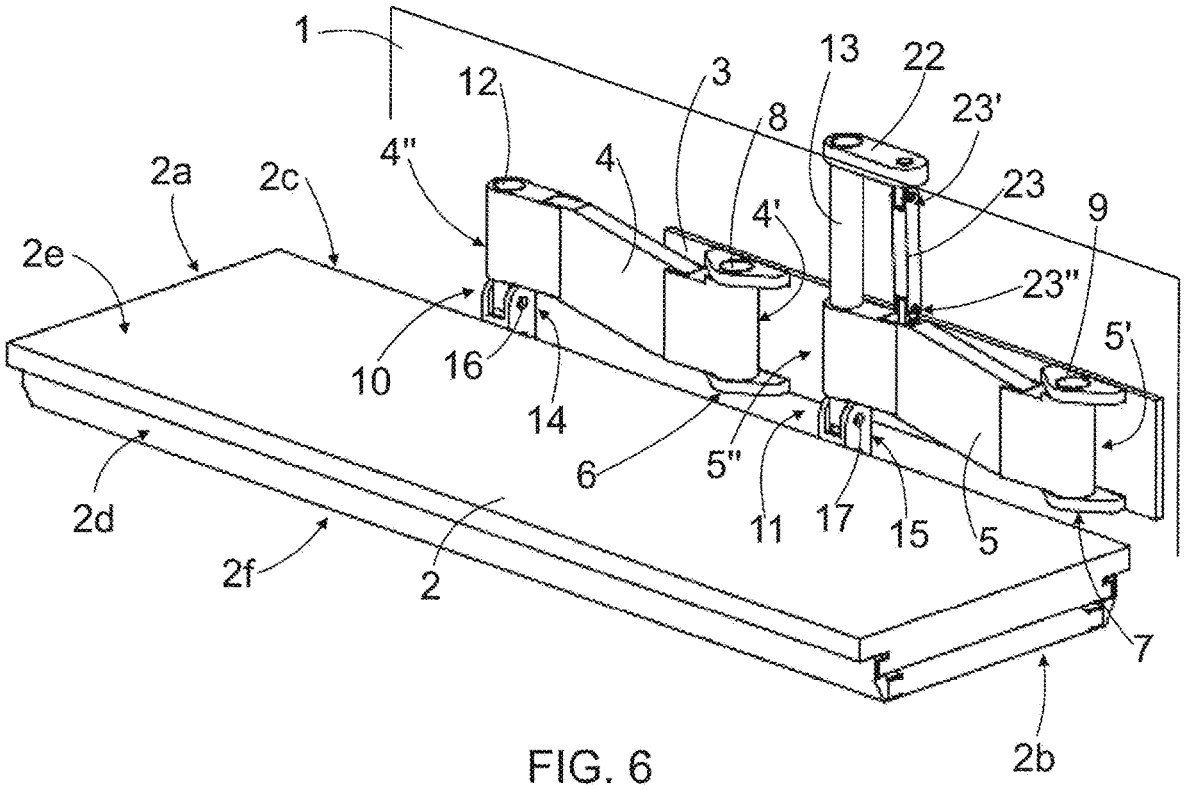
FIG. 6 is a schematic view obliquely from above of a second arrangement for mounting a plane to a wall when the plane is in its horizontal usage position alongside the wall.
Figure 7:
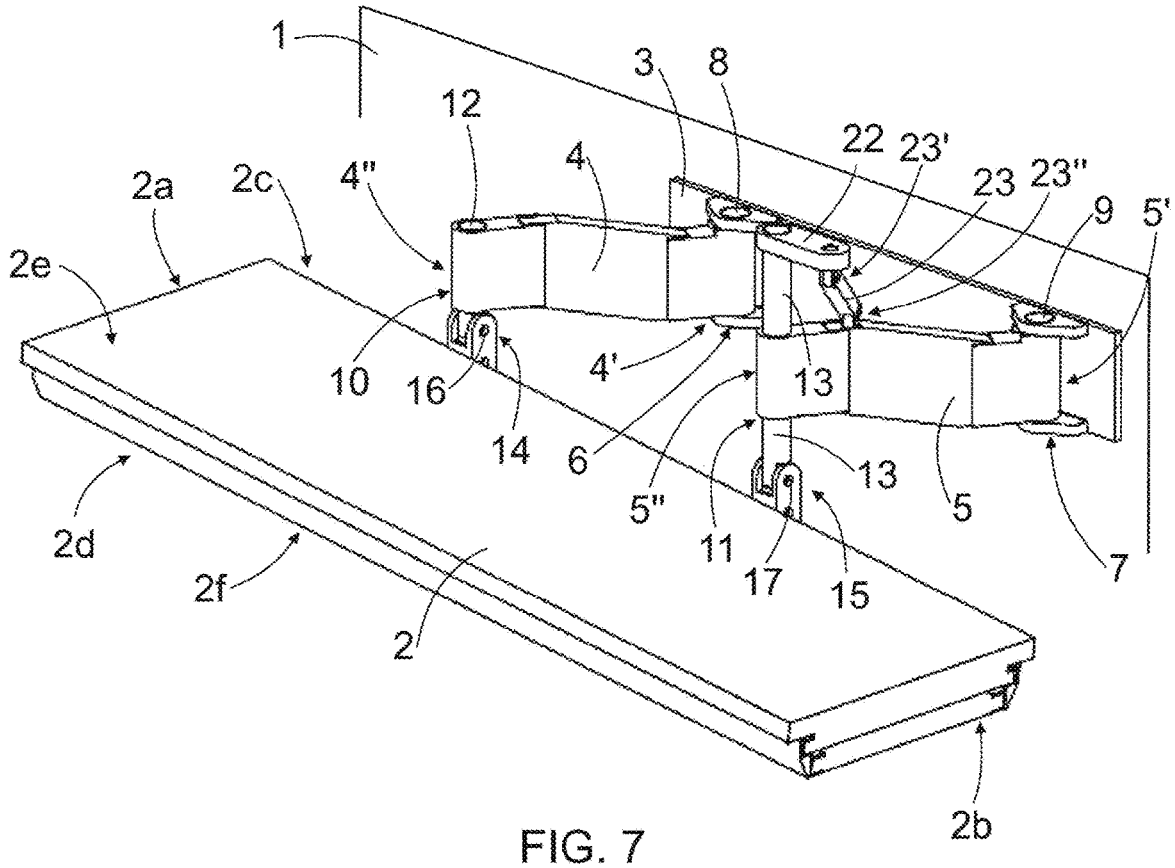
FIG. 7 is a schematic view obliquely from above of the arrangement of FIG. 6 when the plane is in its horizontal usage position and moved outward from the wall.

FIG. 6 is a schematic view obliquely from above of a second arrangement for mounting a plane 2 to a wall 1 when the plane 2 is in its horizontal usage position alongside the wall 1, and FIG. 7 is a schematic view obliquely from above of the arrangement of FIG. 6 when the plane 2 is in its horizontal usage position and moved outward from the wall 1. The arrangement shown in FIGS. 6 and 7 differs from the arrangement of FIGS. 1 to 5 in the following respect.

In the arrangement shown in FIGS. 6 and 7, the vertical joint shaft 13 in the second joint arrangement 11 of the second support arm 5 is dimensioned and arranged in the second joint arrangement 11 so that the joint shaft 13 is adapted to extend, in the vertical direction of the support arm 5, both below and under the second end 5" of the support arm 5. In this case, it is possible to arrange the joint 15 of FIGS. 1 to 5, which is provided with a substantially horizontal turning axis, in connection with the portion of the joint shaft 13, extending below the second end 5" of the support arm 5. In connection with the portion of the joint shaft 13, which extends over the second end 5" of the support arm 5, it is possible in turn to arrange a protrusion 22, and in connection with the protrusion 22, a guide rod 23 a first end 23" of which is pivoted to the protrusion 22 and a second end 23" is pivoted to the support arm 5 to the portion of the support arm 5 between the first joint arrangement 7 and second joint arrangement 11. Alternatively, the first end 23' of the guide rod 23 may be pivoted directly to the portion of the joint shaft 13, which extends over the second end 5" of the support arm 5.

The guide rod 23 forms a forced-control element which guides or forces the joint shaft 13 to slide downward in the vertical direction of the second end 5" of the support arm 5. The forced control is the result of the vertical height of the guide rod 23 reducing when the guide rod 23 turns from the substantially vertical position of FIG. 6 towards the more horizontal position according to FIG. 7 when the support arm 5 turns to an adequate extent away from the wall 1 at the time the plane 2 is being moved away from the wall 1. In such a case, the second end 2*b* of the plane 2 descends whereby it is easier to load e.g a plane 2 located high with a stretcher supporting a patient lying down, compared to a situation where the plane 2 is in a substantially horizontal position. Correspondingly, when the plane 2 is moved back towards the wall 1, the vertical height of the guide rod 23 increases as the support arm 5 is turning back towards the wall 1, which forces the joint shaft 13 to slide upwards in the vertical direction of the second end 5" of the support arm 5, resulting in that the plane 2 rises back to a substantially horizontal position.

In connection with the joint shaft 13, a gas spring may also be installed, which affects the joint shaft 13 in an upward lifting manner and makes the plane 2 lighter to lift.

FIGS. 6 and 7 further show an embodiment of the support arm 4, 5 where the support arm 4, 5 comprises in the portion between the first joint arrangement 6, 7 and the second joint arrangement 10, 11 an obliquely running portion so that the first end 4',5' and second end 4",5" of the support arm 4, 5 are at mutually different heights. This embodiment may be utilized, for example, in solutions where there are accessories, equipment or electrical or air etc. connections fixed to the vehicle wall so that the first ends 4',5' and second ends 4",5" of the support arms 4, 5 must be arranged at mutually different heights. This embodiment may therefore also be made use of in the embodiment according to FIGS. 1 to 5. The first ends 4',5' of the supports arms 4, 5 may be arranged higher than the second ends 4",5" of the support arms 4, 5 e.g. in a situation where accessories, equipment or electrical or air etc. connections fixed to the vehicle wall 1 prevent mounting the first ends 4',5' of the support arms 4, 5 lower on the wall 1, but it is undesirable to raise the plane 2 higher at least to the same extent. The second ends 4",5" of the supports arms 4, 5 may be arranged higher than the first ends 4',5' of the support arms 4, 5 e.g. in a situation where accessories, equipment or electrical or air etc. connections fixed to the vehicle wall 1 prevent mounting the first ends 4',5' of the support arms 4, 5 higher on the wall 1, but it is desirable to arrange the plane 2 in its substantially horizontal usage position to a higher level from the floor level of the vehicle due to smoothly performing a treatment procedure, for example.

Figure 8:
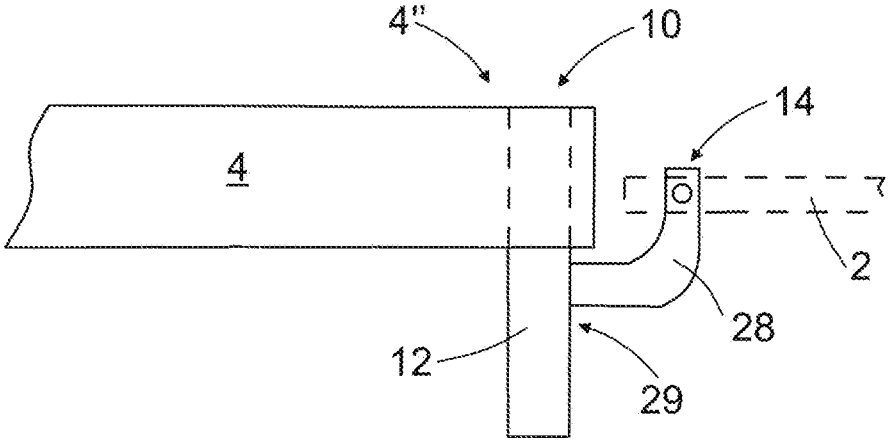
FIG. 8 is schematic end view of a detail of a third arrangement for mounting a plane on a wall when the plane is in its horizontal usage position.

FIG. 8 is a schematic end view of a detail of a third arrangement for mounting a plane 2 on a wall 1 when the plane 2 is in the horizontal usage position, the plane 2 being shown by dotted lines in FIG. 8. FIG. 8 shows the first support arm 4 and, at its second end 4", a second joint arrangement 10 which comprises a joint shaft 12 running through the second end 4" of the support arm 4 in a substantially vertical direction. FIG. 8 further shows, arranged by means of a connecting part 28 in connection with the portion of the vertical joint shaft 12, which extends below the second end 4" of the support arm 4, a joint 14 provided with a horizontal turning axis, the connecting part 28 being fixed to the joint shaft 12 at a mounting point 29. In this embodiment, the joint 14 provided with a horizontal turning axis is therefore indirectly arranged to the portion of the vertical joint shaft (12, 13), which extends below the second end (4",5") of the support arm (4, 5). The connecting part 28 may be part of the support structure of the plane 2. Naturally, a similar or same type of connecting part may be used in connection with the vertical joint shaft 13 running through the second end 5" of the second support arm 5.

The connecting part 28 may be a substantially straight part whereby the joint 14 provided with a horizontal turning axis is placed in the vertical direction of the vertical joint shaft 12 to substantially the same location or height as the mounting point 29, or as shown in FIG. 8, a connecting part 28 comprising at least one change in direction, whereby the joint 14 provided with a horizontal turning axis is placed in the vertical direction of the vertical joint shaft 12 to a different height or location in relation to the mounting point 29. By means of the connecting part 28, it is possible to affect e.g. the location of the plane 2 in the vertical direction of the mounting arrangement to achieve a suitable height of the plane 2 for treating a patient when the plane 2 is in the horizontal usage position, or a suitable height and/or distance in relation to other appliances or equipment mounted on the wall 1 when the plane 2 is in the substantially vertical storage position.

In the solutions presented in the figures, the support arms 4, 5 are formed of one piece. The support arms 4, 5 may also be formed of two or more parts joined in a fixed or pivoted manner to each other.

Those skilled in the art will find it obvious that, as technology advances, the basic idea of the invention may be implemented in many different ways. The invention and its embodiments are thus not restricted to the examples described above but may vary within the scope of the claims.

The invention claimed is:

1. An arrangement for mounting a plane on a wall, the arrangement comprising said plane and, supporting said plane, a first support arm and a second support arm, which support arms are connectable to the wall by their first end by means of a first joint arrangement provided with a substantially vertical turning axis and corresponding to each support arm so that the support arms are turnable in a substantially horizontal plane in relation to the wall, and the support arms be ing mounted in connection with the plane by their second end by means of a second joint arrangement connected the second end of the support arm, the second joint arrangement of the support arm comprising a joint provided with a substantially horizontal turning axis, whereby said plane is turnable to a substantially horizontal usage position and a substantially vertical storage position by means of said joints provided with the substantially horizontal turning axis, and wherein the second joint arrangement comprises a substantially vertical joint shaft arranged in connection with the second end of the support arm, the joint provided with the substantially horizontal turning axis is arranged in said substantially vertical joint shaft of the second joint arrangement, and wherein the substantially vertical joint shaft of the second joint arrangement comprises in the vertical direction of the support arm a portion extending below the second end of the support arm, and the joint of the second joint arrangement, which is provided with the substantially horizontal turning axis is arranged directly or indirectly to the portion of the vertical joint shaft, which extends below the second end of the support arm.

2. An arrangement as claimed in claim 1, wherein the joint of the second joint arrangement, which is provided with a substantially horizontal turning axis, is arranged to the portion of the vertical joint shaft, which extends below the second end of the support arm.

3. An arrangement as claimed in claim 1, wherein a joint shaft (16, 17) of the joint (14, 15) of the second joint arrangement (10, 11), provided with a substantially horizontal turning axis, is arranged to run through the portion of the substantially vertical joint shaft, which extends below the second end of the support arm.

4. An arrangement as claimed in claim 2, wherein the substantially vertical joint shaft of the second joint arrangement is arranged to run in a substantially vertical direction through the second end of the support arm.

5. An arrangement as claimed in claim 1, wherein the arrangement comprises a support structure connected to each support arm, the support structure being arranged in connection with a bottom of the plane, and the support structure connects to the corresponding support arm by means of the joint of said second joint arrangement, which is provided with a substantially horizontal turning axis.

6. An arrangement as claimed in claim 5, wherein the substantially vertical joint shaft of the second joint arrangement forms a first joint part of the joint provided with a substantially horizontal turning axis, and the support structure forms a second joint part of the joint provided with a substantially horizontal turning axis.

7. An arrangement as claimed in claim 5 wherein the support structure comprises a first portion oriented substantially vertically, and in connection with it a second portion oriented substantially horizontally and arranged in connection with the bottom of the plane, whereby said substantially vertically oriented first portion of the support structure forms the portion of the support structure, which is connected to the joint provided with said horizontal turning axis.

8. An arrangement as claimed in claim 7, wherein the substantially horizontally oriented second portion of the support structure is a support structure running substantially in the lateral direction of the plane.

9. An arrangement as claimed in claim 5, wherein the bottom of the plane comprises recesses, that match the second portions of the support structures to be positioned in connection with the bottom of the plane, to receive said portions of the support structures without adding to the height of the plane.

10. An arrangement as claimed in claim 1, wherein the joint shaft of the joint provided with a horizontal turning axis is arranged over the top surface of said plane when the plane is in the substantially horizontal usage position.

11. An arrangement as claimed in claim 1, wherein the first joint arrangement comprises a substantially vertical joint shaft which is arranged to run in a substantially vertical direction through the first end of the support arm.

12. An arrangement as claimed in claim 1, wherein the substantially vertical joint shaft of the second joint arrangement of the second support arm is arranged to slide in a substantially vertical direction in relation to the second end of the second support arm, whereby said joint shaft forms a height adjustment bar by means of which the rear end of the plane may be lowered down to achieve an inclined position for the plane, and raised back up to restore the substantially horizontal position of the plane.

13. An arrangement as claimed in claim 12, wherein the second support arm has a forced-control element which guides the substantially vertical joint shaft of the second joint arrangement of the second support arm to lower as the support arm is turning away from the wall and to rise when the support arm is turning towards the wall.

14. An arrangement as claimed in claim 13, wherein the substantially vertical joint shaft of the second joint arrangement of the support arm comprises a portion extending in the vertical direction over the second end of the second support arm, and the forced-control element is a guide rod, which guide rod is by its first end fixed in a pivoted manner in connection with the portion of the vertical joint shaft of the second joint arrangement, which extends over the second end of the second support arm, and in that the guide rod is fixed in a pivoted manner by its second end to the second support arm to the portion between the first joint arrangement and the second joint arrangement.

15. An arrangement as claimed in claim 1, wherein the support arm comprises in the portion between the first joint arrangement and the second joint arrangement an obliquely running portion so that the first end and second end of the support arm are at mutually different heights.

16. An arrangement as claimed in claim 2, wherein a joint shaft of the joint of the second joint arrangement, provided with a substantially horizontal turning axis, is arranged to run through the portion of the substantially vertical joint shaft, which extends below the second end of the support arm.

17. An arrangement as claimed in claim 3, wherein the substantially vertical joint shaft of the second joint arrangement is arranged to run in a substantially vertical direction through the second end of the support arm.

18. An arrangement as claimed in claim 6, wherein the support structure comprises a first portion oriented substantially vertically, and in connection with it a second portion oriented substantially horizontally and arranged in connection with the bottom of the plane, whereby said substantially vertically oriented first portion of the support structure forms the portion of the support structure, which is connected to the joint provided with said horizontal turning axis.

19. An arrangement as claimed in claim 6, wherein the bottom of the plane comprises recesses, that match the second portions of the support structures to be positioned in connection with the bottom of the plane, to receive said portions of the support structures without adding to the height of the plane.

20. An arrangement as claimed in claim 7, wherein the bottom of the plane comprises recesses, that match the second portions of the support structures to be positioned in connection with the bottom of the plane, to receive said portions of the support structures without adding to the height of the plane.

* * * * *